US006014617A

United States Patent [19]

Kawahara

[11] Patent Number: 6,014,617

[45] Date of Patent: Jan. 11, 2000

[54] METHOD AND APPARATUS FOR EXTRACTING A FUNDAMENTAL FREQUENCY BASED ON A LOGARITHMIC STABILITY INDEX

[75] Inventor: Hideki Kawahara, Kyoto, Japan

[73] Assignee: ATR Human Information Processing Research Laboratories, Kyoto, Japan

[21] Appl. No.: 08/905,545

[22] Filed: Aug. 4, 1997

[30] Foreign Application Priority Data

Jan. 14, 1997 [JP] Japan ..... 9-017505

[51] Int. Cl.[7] ..... G10L 3/02

[52] U.S. Cl. ..... 704/207; 704/205

[58] Field of Search ..... 704/201, 203, 704/204, 205, 207, 209

[56] References Cited

U.S. PATENT DOCUMENTS 5,214,708 5/1993 McEachern ..... 381/48

FOREIGN PATENT DOCUMENTS 0 386 820 9/1990 European Pat. Off. .

OTHER PUBLICATIONS

Potamianos et al, "Speech Formant Frequency and Bandwidth Tracking Using Multiband Energy Demodulation", ICASSP '95, Acoustics, Speech and Signal Processing, May 1995.

Orr, "A Gabor sampling Theorem and Some Time–Bandwidth Implications", ICASSP '94.

Maragos, "Speech nonlinearities, modulations, and energy operators", ICASSP '91.

Qian, "Signal approximation via data–adaptive normalized Gaussian functions", ICASSP '92.

Potamianos et al., "A Comparison of the energy operator and the Hilbert transform approach to signal and speech demodulation", *Signal Processing,* (1994) vol. 37, pp. 95–120.

*Primary Examiner*—David R. Hudspeth
*Assistant Examiner*—Michael N. Opsasnick
*Attorney, Agent, or Firm*—McDermott, Will & Emery

[57] ABSTRACT

A speech signal input from a microphone is distributed by a distribution amplifier. Using output signals of a filter group of cos phase having cut-off frequency moderate on low frequency side and steep on high frequency side and of similar filter group of sin phase, stability index is calculated based on magnitude of amplitude modulation and magnitude of frequency modulation of the signals, by stability index calculating portion and fundamental frequency extracting portion. Based on the result of calculation, approximate value of fundamental frequency is calculated based on an output of a channel indicating maximum stability, and based on the approximate value of fundamental frequency, instantaneous frequency extracting portion extracts precise instantaneous frequency as fundamental frequency, interpolating value of instantaneous frequency from adjacent frequency channels.

8 Claims, 12 Drawing Sheets

METHOD AND APPARATUS FOR EXTRACTING A FUNDAMENTAL FREQUENCY BASED ON A LOGARITHMIC STABILITY INDEX

BACKGROUND OF THE INVENTION

1. Field of the Invention

The present invention relates to a method and an apparatus for signal analysis. More specifically, the present invention relates to a method and an apparatus for signal analysis used not only in the speech related field such as extraction of fundamental frequency for speech analysis and synthesis but also in the field of extraction of periodicity of biological signals and diagnosis of machine vibration, for extracting fundamental frequency of periodic signals and almost periodic signals.

2. Description of the Background Art

It is desired to correctly find fundamental frequency of a periodic signal in the field of speech analysis, for example. However, satisfactory method has not yet been found. In a conventional method, based on a definition of periodic signal, a period T defined below is found, the reciprocal of which is regarded as the fundamental frequency. Here, p(t) is the periodic signal to be analyzed and neZ is an arbitrary integer.

$$p(t)=p(t+nT) \tag{1}$$

Conventional method for obtaining period of such signal includes ① time domain method, ② frequency domain method, ③ auto correlation domain method and ④ a method of studying waveform singularity. Any of these methods cause some problem when applied to actual audio signals, and hence it has been generally believed that there is not a generally applicable universal method.

In time domain method (①), for example, a waveform is passed through a nonlinear circuit and then through a low pass filter, followed by extraction of a zero cross point or extraction of a peak position, to detect the period. In such a method, even when the period is roughly known in advance, much adjustment including setting of frequency of low pass filter or nonlinear circuit, method of detecting the peak and so on, and error derived from difference in signal level or spectrum shape has been unavoidable.

Representative one of the frequency domain method (②) is to extract a peak of cepstrum which is defined as a Fourier transform of logarithmic power spectrum. According to this method, if periodicity is perfect, correct period is obtained in principle. However, for the signals such as speech signal which is approximately periodical but has variation at each period, the method requires know-how to prevent various errors such as low peak, erroneous extraction of peaks caused by resonance such as speech formant, or erroneous taking of two periods as one.

Another problem, which is common to the method of auto correlation described below, is that it is necessary to increase time length of the signal used for analysis when the period is to be calculated precisely, and that the method cannot follow time change if the time change is fast as in the case of a speech, and further, when time window is made sufficiently short to follow the change, periodicity cannot be correctly extracted.

One method based on auto correlation (③) normalizes detailed power spectrum shape in accordance with global power spectrum shape using time windows of different lengths, modified auto correlation is calculated by inverse Fourier transform, and the signal period is calculated as the position of the peak thereof. However, as pointed out with respect to the cepstrum above, this method also suffers from similar problems concerning how to cope with fast changing period and where to tell global shape from detailed shape.

A method has been proposed which calculates, noting the fact that influence of global spectrum shape is removed from a residual signal obtained as a result of linear predictive analysis, the fundamental frequency from auto correlation of the residual signal. However, this method also suffers from the similar problem for fast changing signals.

The method of studying waveform singularity (④) assumes that a periodic signal is driven periodically by some event, which is the cause of periodicity, so that in this method, position of event is calculated to extract basic period and to find basic frequency. There is also a method noting phase of wavelet transformation as means therefor which is a relatively new method of signal analysis. However, in this method also, it is unclear what wavelet is to be used, and which of the detected signals is to be used for extracting fundamental period as a main event.

Because of these difficulties in principle, according to the conventional methods, a fraction of an integer or an integer multiple of an estimated value of the basic frequency may possibly be estimated erroneously as the fundamental frequency.

SUMMARY OF THE INVENTION

Therefore, an object of the present invention is to provide method and apparatus for signal analysis capable of correctly extracting fundamental frequency of a periodic signal, in view of the fact that instantaneous frequency of fundamental component coincides with the fundamental frequency.

Briefly stated, the present invention relates to a method of signal analysis for extracting fundamental frequency of an input signal including a first step of calculating, using a group of filters having such a cut-off characteristic that is moderate on low frequency side and steep on high frequency side, a stability index which is a mathematical index representing fundamentalness of the fundamental component of the input signal, for each filter output, and a second step of extracting fundamental frequency as instantaneous frequency by using a filter output of which the stability index provides the maximum value.

Therefore, according to the present invention, mathematical index representing fundamentalness of the fundamental component of the input signal is calculated to select a filter which has the maximum fundamentalness and fundamental frequency as instantaneous frequency can be extracted by using a filter having the specific shape described above. By searching for fundamental component included in an arbitrary signal by this method, it is possible to diagnose abnormality from sound of a mechanical device and to analyze periodicity of a biological signal, and thus the present invention is applicable to various fields. Further, in a field of amusement, the present invention enables correct extraction of singing pitch. Therefore, the present invention is applicable to wide variety of fields including automatic music transcription, broadcasting or fabrication of compact disks.

Specifically in a typical implementation, the first step includes the step of calculating magnitude of amplitude modulation and magnitude of frequency modulation of a filter output signal, using an output of a filter having such a cut-off characteristic that is moderate on low frequency side and steep on high frequency side.

The second step includes the step of calculating a stability index based on the magnitude of amplitude modulation and on the magnitude of frequency modulation, and calculating approximate value of fundamental frequency as instantaneous frequency from an output of a channel which shows maximum stability based on the result of calculation of the stability index.

In a more preferred embodiment, the second step includes the step of extracting precise instantaneous frequency by interpolating a value of a instantaneous frequency from an adjacent frequency channel based on the approximate value of fundamental frequency.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
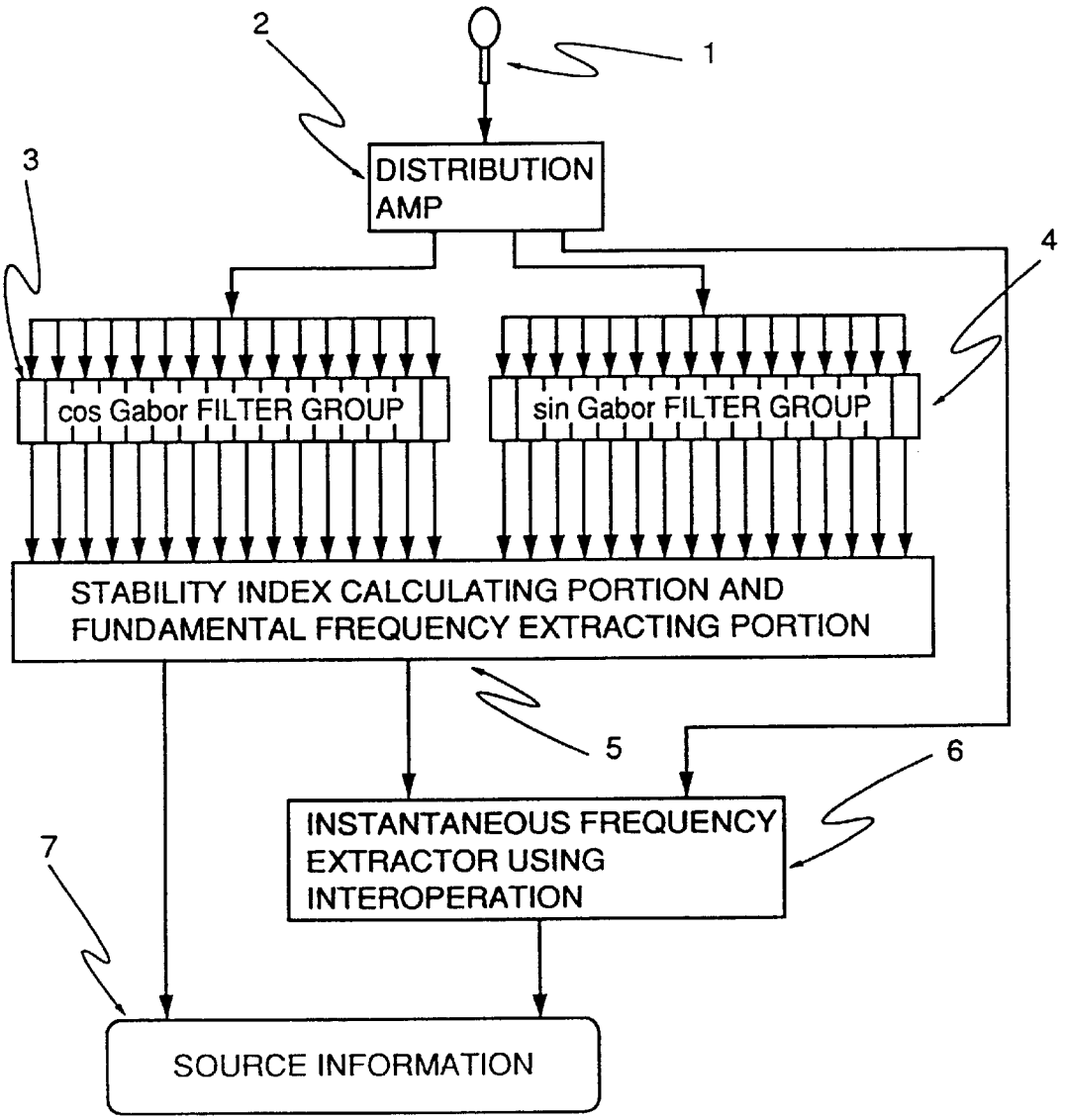
FIG. 1 is a block diagram showing the fundamental frequency extracting apparatus in accordance with the first embodiment of the present invention.

Prior to the description of the embodiments, principle of the present invention will be described. Conventional pitch extracting methods have failed because these methods tried to directly obtain the fundamental frequency from the definition of a periodic signal. In the present invention, instantaneous angular frequency ω(t) defined by the following equations is calculated with respect to the fundamental component of an almost periodic signal s(t).

$$\omega(t) = \frac{d\phi(t)}{dt} \tag{2}$$

$$\phi(t) = \arctan\left[-\frac{H[s(t)]}{s(t)}\right] \tag{3}$$

Here H[] represents Hilbert transform of a signal. Hilbert transform provides a signal by rotating 90° the phase of harmonic component of a signal. Instantaneous frequency f(t) is calculated in accordance with the equation f(t)=ω(t)/2π.

An almost periodic complex tone c(t) such as speech can be represented by using instantaneous frequency in accordance with the following equation (4).

$$c(t) = \sum_{k\in N} \alpha_k(t)\sin\left(k\int_{t0}^{t}\omega(\tau)d\tau + \psi_k(t)\right) \tag{4}$$

Here, $\alpha_k(t)$ and $\phi_k(t)$ represent amplitude modulation (AM) component of harmonic structure and small phase modulation (PM) component, respectively. The major part of or majority of frequency modulation (FM) is provided by a change in ω(t). Here, by appropriately setting time origin, the following discussions still holds even when $\phi_1(t)$ is set to 0. N represents a set of natural numbers. Therefore, only if fundamental component is provided, the instantaneous frequency calculated in accordance with the equation (2) would be the same as the fundamental frequency.

Relation between the instantaneous frequency defined in this manner and the fundamental frequency calculated in accordance with the conventional method will be briefly described. Assume that $\alpha_k(t)$ and $\phi_k(t)$ are distributed at random and mean value is 0, the estimated value of fundamental frequency calculated by the correlation method or the like is equal to the mean value of instantaneous frequencies over a long period of time. For a periodic signal, these are essentially equivalent. For an almost periodic signal, correct value is obtained only by the method based on instantaneous frequency not including an extra step of averaging.

As described above, instantaneous frequency of the fundamental wave has superior characteristic. However, it has not been utilized because of the problem as to how the fundamental component of which instantaneous frequency is desired should be obtained. In order to find instantaneous frequency, it is necessary to take out fundamental component, which means calculation of fundamental frequency. Without some measure to break the deadlock, this leads to a tautology. This is why the instantaneous frequency of the fundamental component, which has various superior characteristics, has not yet utilized to date.

Therefore, in the present invention, the deadlock is broken by using a measure other than the frequency to select fundamental component. For this purpose, the following characteristic of signal processing using a filter having such a cut-off characteristic that is moderate on low frequency side and steep on high frequency side is utilized. More specifically, when the central frequency of the filter is different from the fundamental component of a signal, frequency modulation of instantaneous frequency of the filter output and amplitude modulation of envelope component of the filter output increase. The reason for this is that signal to noise ratio of the fundamental wave and other components becomes maximum when the central frequency of the filter and the frequency of fundamental component of the signal coincide with each other.

When the central frequency of the filter and the frequency of higher order harmonic component of the signal coincide with each other, the signal to noise ratio increases. However, since the filter has moderate low-cut off characteristic, a plurality of harmonic components exist in one filter output, and therefore variation of instantaneous frequency and amplitude modulation of envelope component of the filter output increase. There are many filters satisfying such condition. Practically, it is convenient to utilize a complex Gabor function of which frequency resolution is 1.3 to 1.4 times better than the time resolution.

To make discussions simpler, consider a windowing function of which time resolution and frequency resolution are balanced in the following manner. First, select a time window a product of time resolution and frequency resolution of which is minimum and ratios of respective resolutions with respect to the fundamental period and fundamental frequency of the signal are equal to each other. A time window w(t) satisfying this requirement is the following Gaussian function, of which Fourier transform W(ν) is represented by the following equation.

$$w(t) = \frac{1}{\tau_0} e^{-\pi(\tau/\tau_0)^2} \tag{5}$$

$$W(\nu) = \frac{1}{\sqrt{2\pi}} e^{-\pi(\nu/\nu_0)^2} \tag{6}$$

where $\nu_0=2\pi f_0$. Using this window function and multiplying by a signal of which real part and imaginary part have phases different from each other by 90° and having the period of $\tau_0$, a signal $g_{r0}(t)$ for inspection is defined as follows. The signal $g_{r0}$ defined in this manner is an inspection signal for detecting a signal having the period of $\tau_0$.

$$g_{\tau_0}(t) = e^{-\pi(t/\tau_0)^2} e^{-j\frac{2\pi t}{\tau_0}} \tag{7}$$

This signal also corresponds to a Gabor function defined below with $\alpha=\tau^2_0/4\pi$.

$$g_\alpha(t) = \frac{1}{2\sqrt{\pi\alpha}} e^{\frac{t^2}{4\alpha}} \tag{8}$$

The influence of signal periodicity on phase and absolute value of a result of convolution of a signal to be analyzed and the inspection signal is studied. A function D(t, τ) from which the index of fundamentalness is derived, is defined as follows.

$$D(t, \tau) = \int_{t-T}^{t+T} s(u) g_{\tau_0}(t-u)\, du \tag{9}$$

where T represents a range outside of which amplitude of $g_{r0}(t)$ can be regarded as substantially 0. Based on this function, the index M(t, τ) representing fundamentalness is defined as follows.

$$M = -\log\left[\int_\Omega \left(\frac{d|D|}{du}\right)^2 du\right] + \log\left[\int_\Omega |D|^2 du\right] - \log\left[\int_\Omega \left(\frac{d^2 \arg(D)}{du^2}\right)^2 du\right] + \log\Omega(\tau_0) + 2\log\tau_0 \tag{10}$$

The last two terms of equation (10) above are correction terms for normalization of a part dependent of the width of the window and normalization of a part where differential value changes dependent on the frequency of the target signal. By such corrections, when M is calculated with $\tau_0$ changed variously and the value $\tau_0$ providing maximum M is selected, the selected value corresponds to the frequency of fundamental component. An embodiment implementing extraction of fundamental frequency based on this principle will be described in detail in the following.

FIG. 1 is a schematic block diagram showing a fundamental frequency extracting apparatus in accordance with one embodiment of the present invention. Referring to FIG. 1, speech signal is input through an input apparatus such as a microphone 1. The input speech signal has its input level adjusted by a distribution amplifier 2, and distributed and applied to cos Gabor filter group 3, sin Gabor filter group 4 and an instantaneous frequency extractor 6 using interpolation. When fundamental frequency of a speech signal is to be extracted, each of the filters in Gabor filter group is arranged at every 2 1/12 so that 12 filters can be placed over 1 octave in the range of central frequency from 40 Hz to 800 Hz. As a result, in this embodiment, 52 filters are arranged at equal interval on logarithmic frequency axis for cos and sin phases, respectively.

The cos Gabor filter group 3 is a group of filters of which temporal resolution and frequency resolution on cos phase are represented by a balanced equation. By this filter group, a signal corresponding to the real part of the inspection signal to which Gabor function of the equation is applied, is output to respective channels. The sin Gabor filter group 4 is a group of filters of which temporal resolution and frequency resolution on sin phase are represented by a balanced equation and by this filter group, a signal corresponding to the imaginary part of the inspection signal to which the Gabor function of the equation is applied is output to respective channels.

Output signals of respective channels of cos Gabor filter group 3 and sin Gabor filter group 4 are applied to stability index calculating portion and fundamental frequency extracting portion 5. Stability index calculating portion and fundamental frequency extracting portion 5 calculates stability index from the real part signal and the imaginary part signal, and based on the result of calculation, calculates approximate value of fundamental frequency as instantaneous frequency from the data of the channel indicating maximum stability, and applies the result of calculation to instantaneous frequency extractor 6 using interpolation. Instantaneous frequency extractor 6 interpolates value of instantaneous frequency from adjacent frequency channel based on the approximate value of fundamental frequency, and extracts precise instantaneous frequency.

Figure 2:
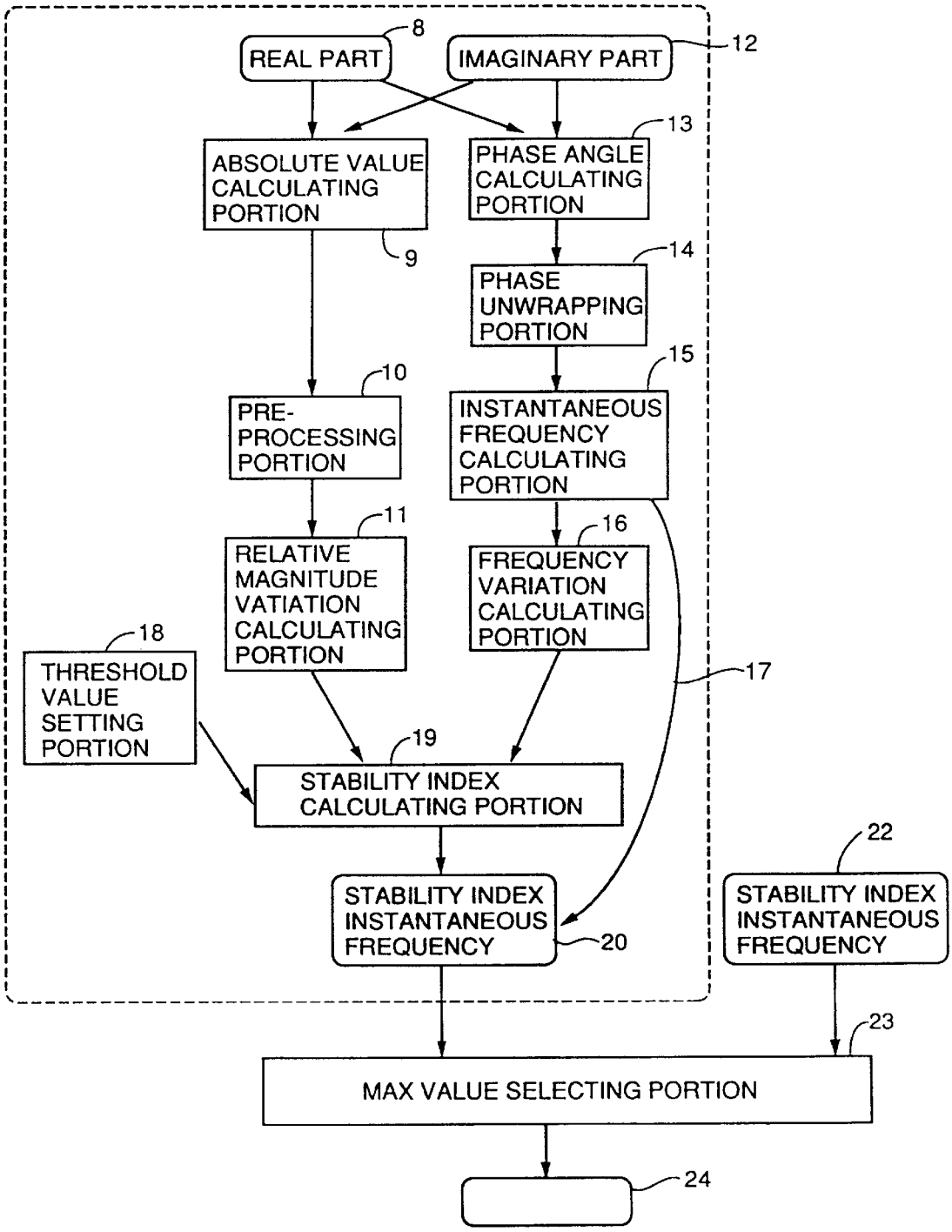
FIG. 2 is a specific block diagram of a stability index calculating portion and a fundamental frequency extracting portion shown in FIG. 1.

FIG. 2 is a specific block diagram of stability index calculating portion and fundamental frequency extracting portion 5 shown in FIG. 1. Corresponding to respective outputs of each channel of COS Gabor filter group 3 and sin Gabor filter group 4 shown in FIG. 1, a channel corresponding portion 21 shown in FIG. 2 is provided, and stability index for each channel is calculated. Calculation is performed in accordance with equation (10) above. The real part 8 of channel corresponding portion 21 is an output of one filter of cos Gabor filter group 3, and imaginary part 12 is an output from one filter of sin Gabor filter group 4.

Real part 8 and imaginary part 12 are applied to absolute value calculating portion 9, root mean squared value of the real and imaginary parts is calculated to provide the absolute value. The absolute value is applied to pre-processing portion 10 for relative magnitude variation calculation, time differential of the absolute value is calculated, root mean squared value is calculated using integration time in accordance with time length of each channel response, and root mean squared value of the absolute value itself is also calculated using the same integration time. Relative magnitude variation calculating portion 11 calculates relative magnitude variation by normalizing the route mean squared value of the time differential calculated by the pre-processing portion 10 by the root mean squared value of the absolute value itself.

The real part 8 and the imaginary part 12 are also applied to a phase angle calculating portion 13, and phase angle calculating portion 13 calculates the phase angle by calculating ratio of imaginary part with respect to the real part. The calculated phase angle is applied to a phase unwrapping portion 14, and phase unwrapping portion 14 connects phases such that jump of $2\pi$ of the phase attains to 0, thus calculating unwrapped continuous phase angle. In instantaneous frequency calculating portion 15, the phase angle unwrapped by phase unwrapping portion 14 is subjected to time differential, whereby instantaneous frequency is obtained. The obtained instantaneous frequency is applied to frequency variation calculating portion 16, time differential of frequency is calculated, root mean squared value is calculated using integration time in accordance with the time length of each channel response, and thus frequency variation is obtained.

A threshold value setting portion 18 sets a threshold value of minimum index which can be regarded stable, based on information of each channel. The set threshold value, relative magnitude variation calculated by relative magnitude variation calculating portion 11, and frequency variation calculated by frequency variation calculating portion 16 are applied to stability index calculating portion 19. In stability index calculating portion 19, stability index is calculated based on the relative magnitude variation, frequency variation, threshold value and channel number and a pair 20 of the stability index and the instantaneous frequency is applied to maximum value selecting portion 23. Similar pair 22 of stability index and instantaneous frequency of other channel is also applied to maximum value selecting portion 23. Based on the stability indices, maximum value selecting portion 23 selects the maximum value and, at the same time, selects a fundamental frequency to be paired. As a result, approximate fundamental frequency information and stability index are extracted.

Figure 3:
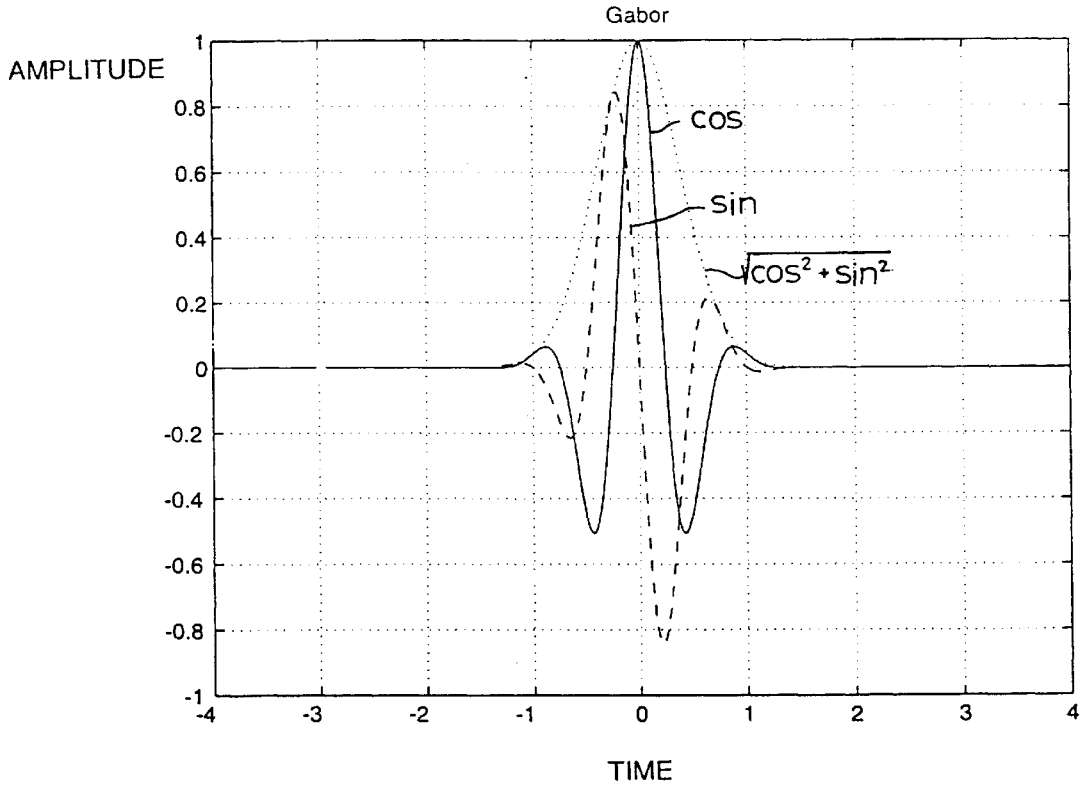
FIG. 3 shows time waveforms of cos, sin and cos $\sqrt{\cos^2+\sin^2}$ of Gabor filter.
Figure 4:
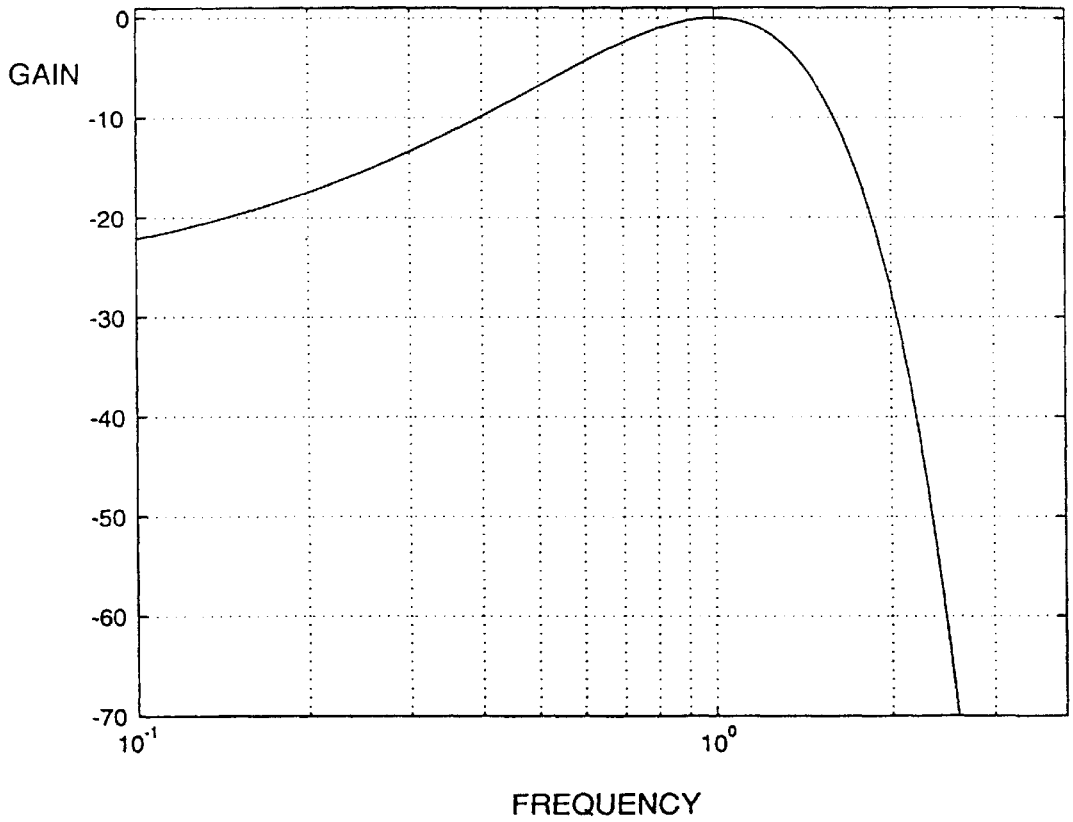
FIG. 4 shows frequency response of the Gabor filter.

FIGS. 3 to 6 are graphs related to one embodiment for improving filter structure. FIG. 3 show waveforms of cos phase component and sin component of a Gabor filter of which frequency resolution and time resolution are balanced, as well as an envelope waveform calculated as squared sum thereof. The waveforms correspond to the real part, imaginary part and the absolute value of equation (5) above. The frequency response of the filter has the characteristic moderate on the low frequency side and steep on high frequency side in the representation where the abscissa represents logarithmic frequency as shown in FIG. 4. Namely, it can be seen that the filter satisfies the condition described above.

However, though the high frequency side is steep in FIG. 4, attenuation at a position of the second harmonic component when the central frequency of the filter matches the fundamental component is only 27 dB. Therefore, when the fundamental component is weak as compared with the second harmonic component, the filter having maximum stability index may not correspond to the fundamental component.

Figure 5:
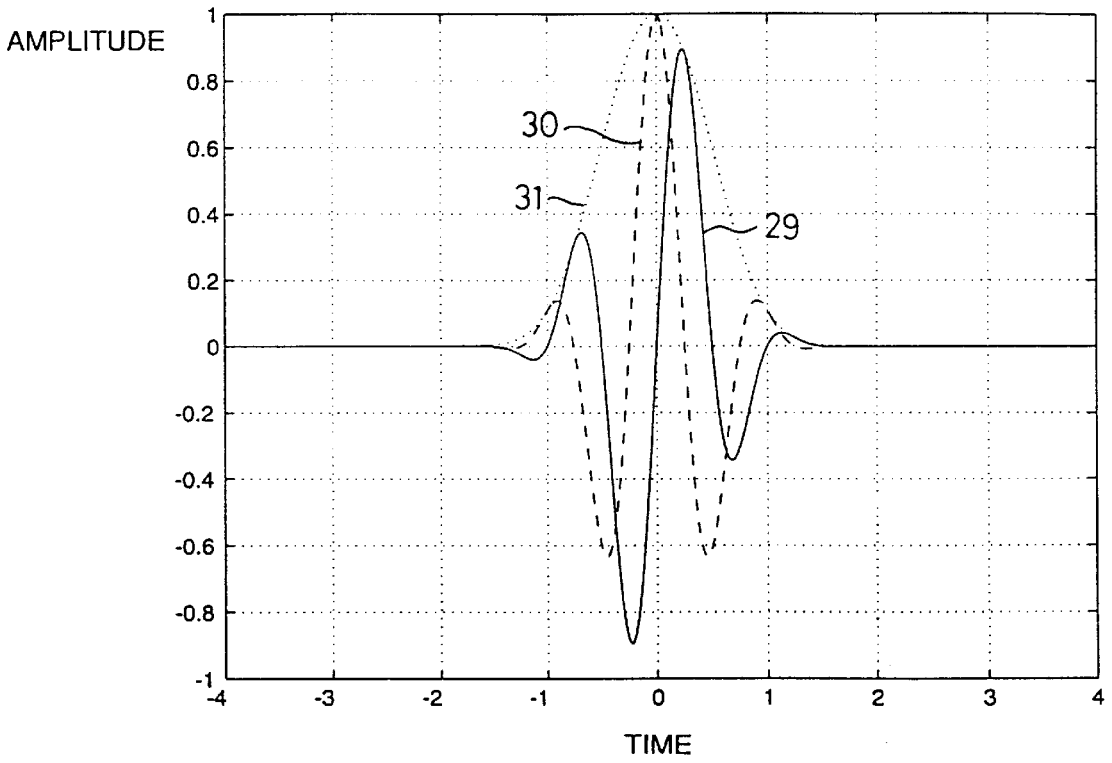
FIG. 5 shows time waveforms of cos, sin and $\sqrt{\cos^2+\sin^2}$ of an alternating Gabor filter with influence from second harmonic removed.
Figure 6:
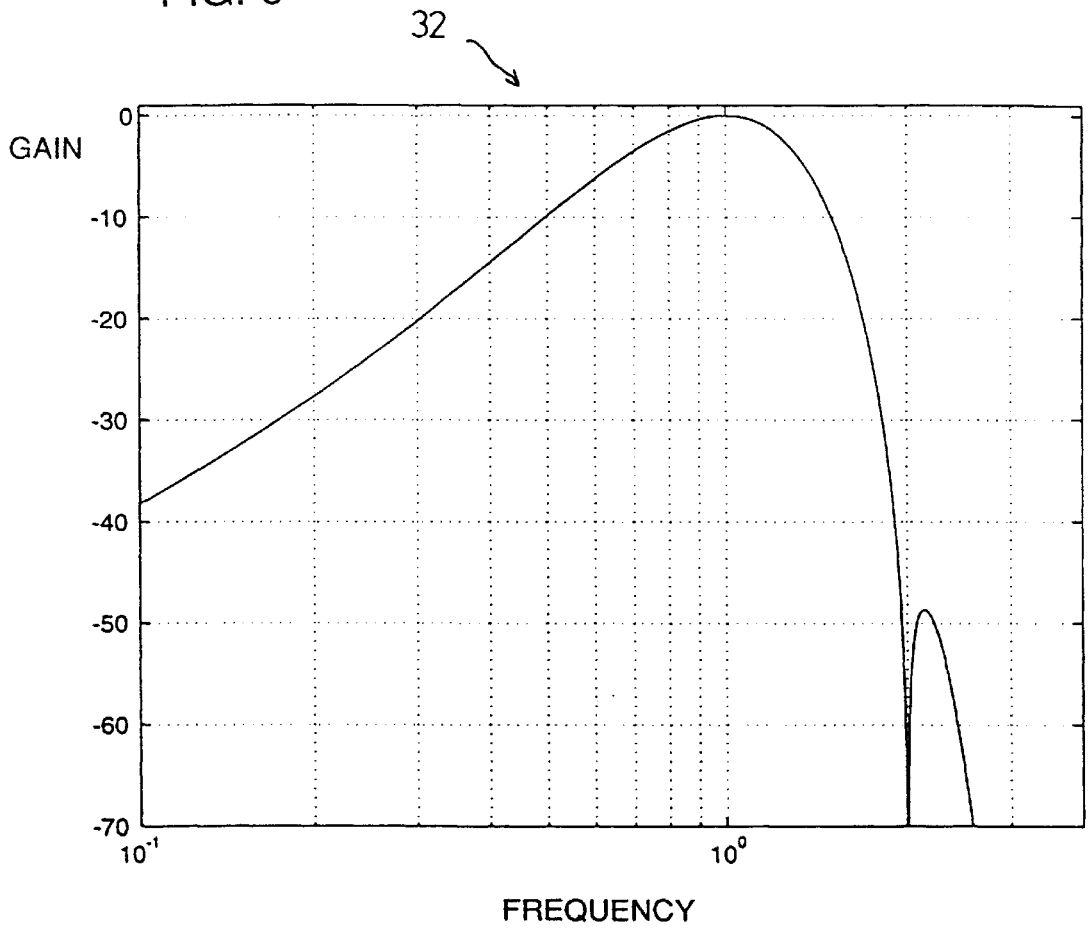
FIG. 6 shows frequency response of the Gabor filter shown in FIG. 5.

FIG. 5 shows an embodiment solving this problem, in which a filter response waveform defined in accordance with the following equation (11) is used.

$$\omega_d(t)=\omega(t-\tau_0/4)-\omega(t+\tau_0/4) \tag{11}$$

A solid line 29 of FIG. 5 represents the real part, a dashed line 30 represents the imaginary part and a doted line 31 represents the absolute value. By using a response waveform formed in this manner, the filter characteristic is much attenuated at the portion of the second harmonic component as shown by 32 of FIG. 6. Accordingly, even when the second harmonic component is large with respect to the fundamental component, it is possible that the filter having maximum stability index corresponds to the fundamental component.

Figure 7:
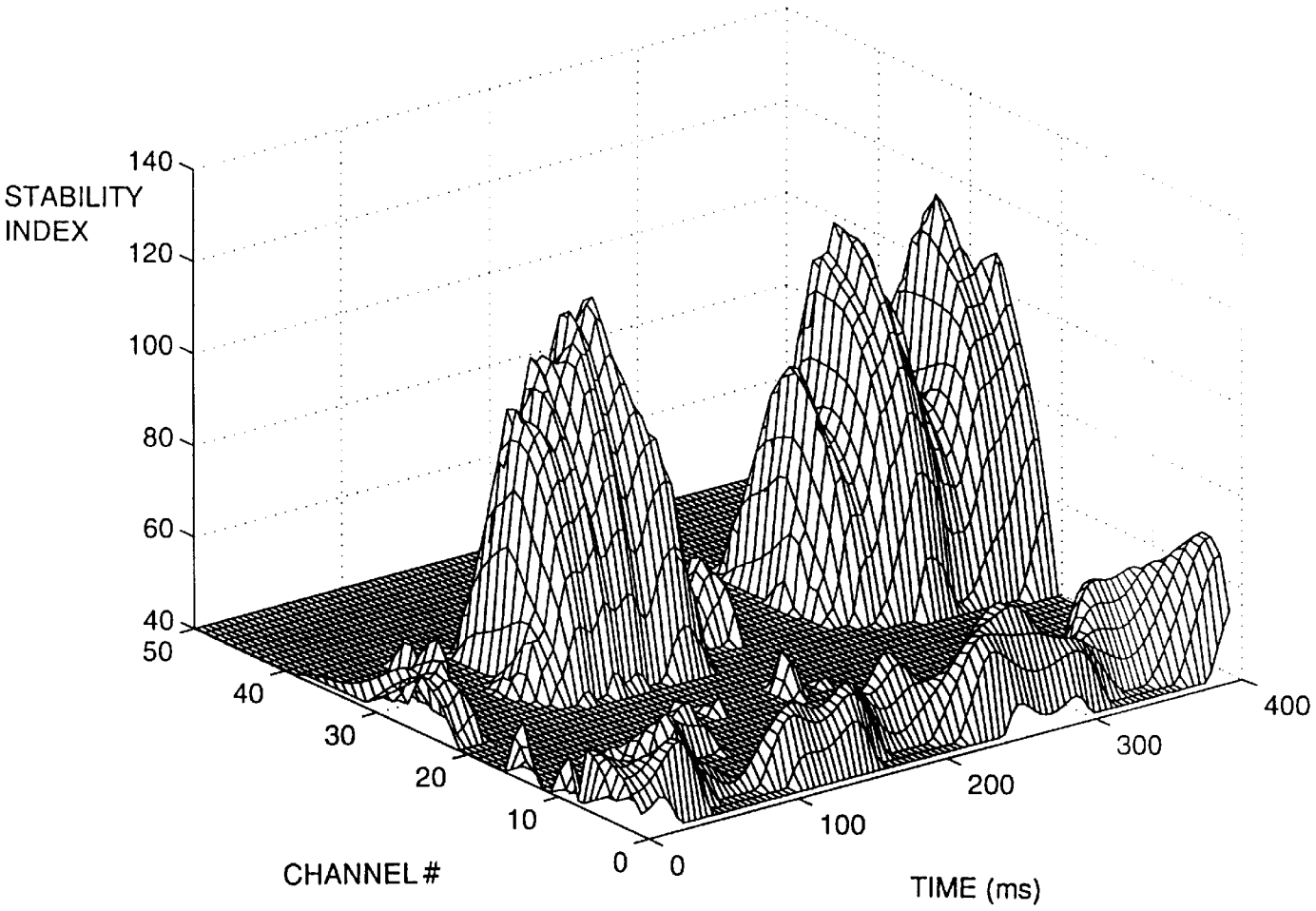
FIG. 7 is a three dimensional plot of the stability index.

FIG. 7 is a three-dimensional plot of the calculated stability index, in which the central high portion corresponds to the fundamental component. The fundamental frequency of the fundamental component is calculated by obtaining instantaneous frequency of a corresponding channel.

Figure 8:
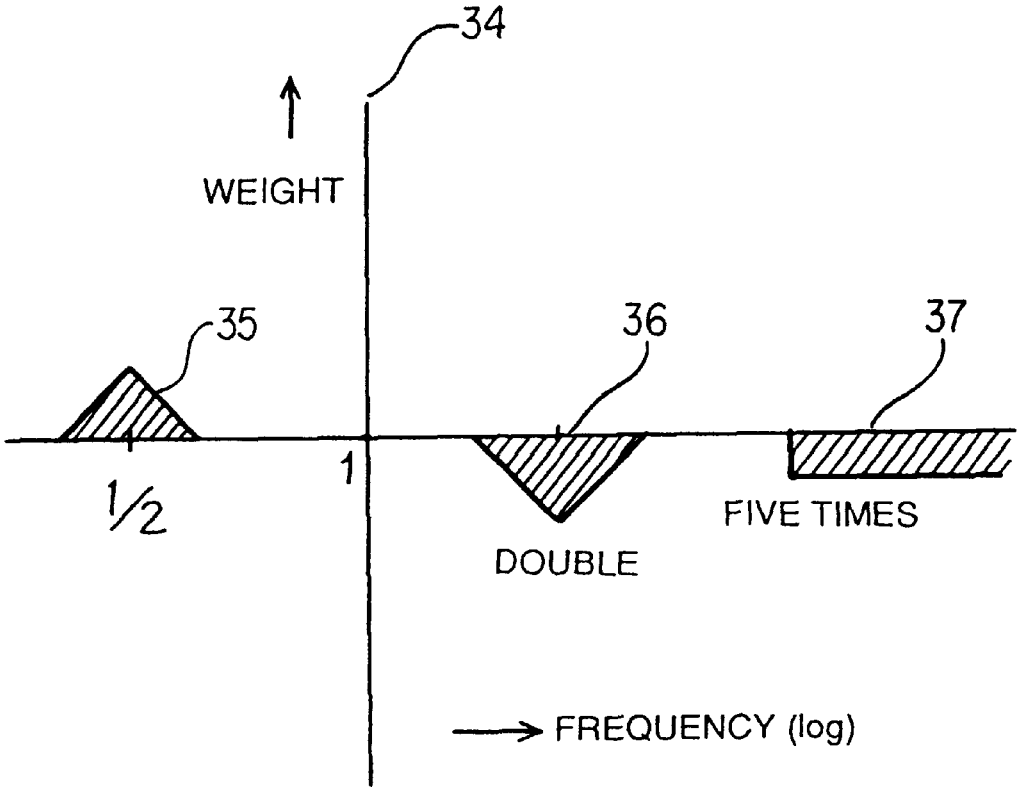
FIG. 8 shows setting of weight for introducing knowledge of harmonic structure and knowledge of vocal cord vibration into the stability index.

FIG. 8 is an illustration showing one embodiment for improving stability index. In actual speech, when the fundamental component is weak or instable or when transient caused by resonance of vocal tract excited by opening/closing of glottis is very strong, the stability index of the filter corresponding to the second harmonic component attains maximum or stability index of a filter corresponding to fifth or higher harmonic component may attain maximum at a rate of several percents, which leads to erroneous extraction. FIG. 8 shows weight setting for introducing knowledge of harmonic structure and knowledge of resonance caused by vibration of vocal cord, in order to reduce such errors. Reference numeral 35 represents weight representing positive influence on half frequency, and 36 represents weight representing negative influence on double frequency. 37 represents weight representing negative influence on fifth or higher frequency components for correcting influence of opening/closing of glottis. The weights defined in this manner will be represented as $\beta(\lambda)$ as a function of logarithmic frequency $\lambda=\log f$. Similarly, the stability index M can be represented as $M(\lambda)$ as a function of logarithmic frequency of the central frequency of the filter. By using these, the stability index $M_m(\lambda)$ modified by the knowledge is calculated in accordance with the equation (12).

$$Mm(\lambda)=\int\beta(\eta-\lambda)M(\eta)d\eta \tag{12}$$

By using the stability index modified by the knowledge in place of the stability index mentioned above, errors caused by weak or instable fundamental wave, very strong resonance of vocal tract associated with opening/closing of glottis can be reduced. This embodiment modifies only the step of operation of the stability index calculating portion represented by 19 in FIG. 2, and the block diagram is the same.

An embodiment for improving the method of calculating stability index will be described.

In a speech, the fundamental frequency is rarely is constant, and it entails elevation or lowering. In such a case, since the stability index is defined using squared sum of variation, seeming stability looks as if it lowers, as movement of elevation or lowering serves as a bias even if it is the fundamental component. In order to avoid this problem, squared sum of an amount, from which mean value of variation in the range $\Omega$ of integration is removed, may be used in calculating stability index. The stability index modified in this manner will be represented as Mc which is calculated in accordance with the equations (13) to (15) below.

$$M_c=-\log\left[\int_\Omega\left(\frac{d|D|}{du}-\mu_{AM}\right)^2du\right]+\log\left[\int_\Omega|D|^2du\right]-\log\left[\int_\Omega\left(\frac{d^2\arg(D)}{du^2}-\mu_{FM}\right)^2du\right]+\log\Omega(\tau_0)+2\log\tau_0 \tag{13}$$

$$\mu_{AM}=\frac{1}{\Omega}\int_\Omega\left(\frac{d|D|}{du}\right) \tag{14}$$

$$\mu_{FM}=\frac{1}{\Omega}\int_\Omega\left(\frac{d^2\arg(D)}{du^2}\right) \tag{15}$$

Figures 9A, 9B, 9C:
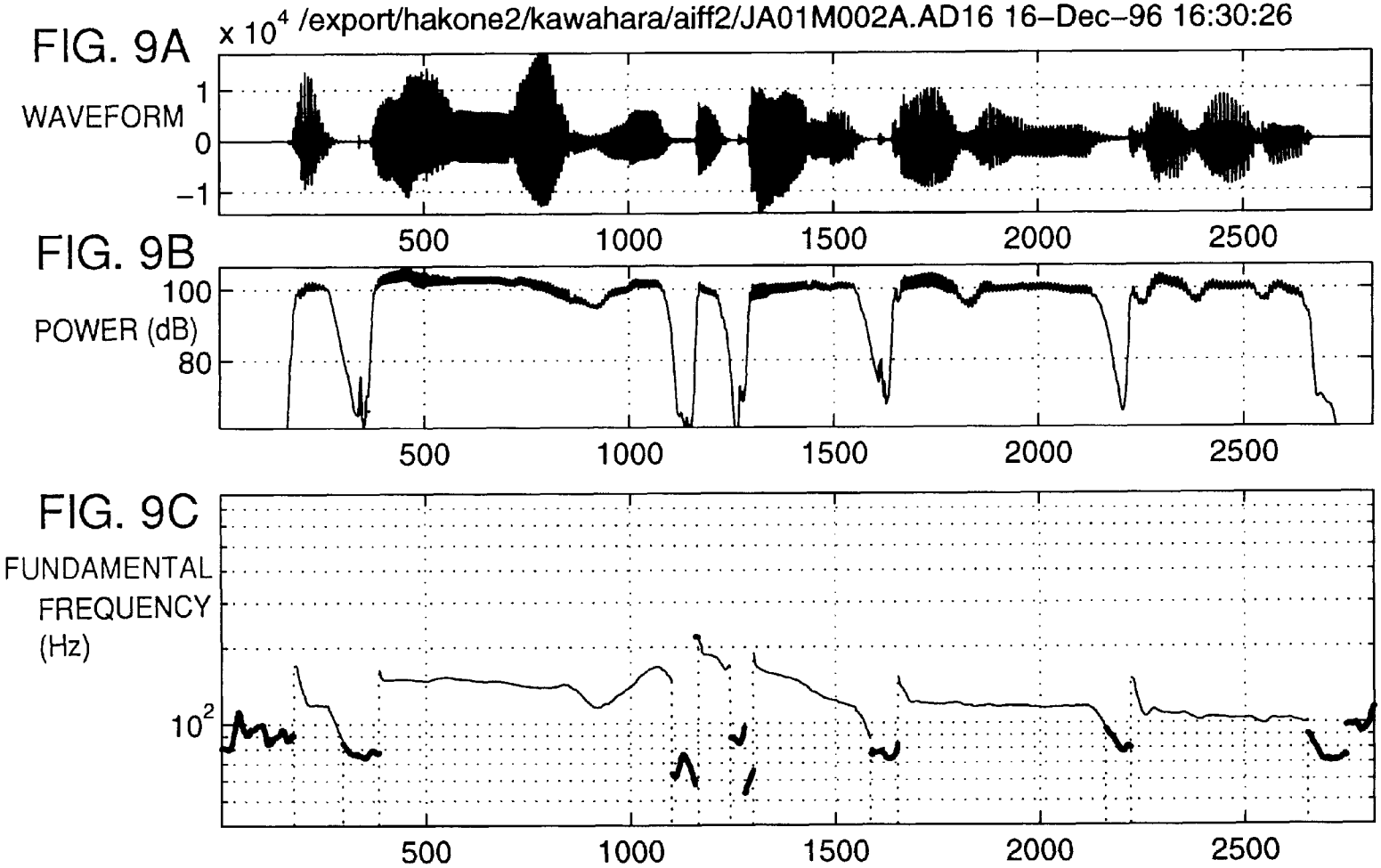
FIGS. 9A–9F are diagrams of waveforms showing result of actual speech waveform analysis.
Figure 9D:
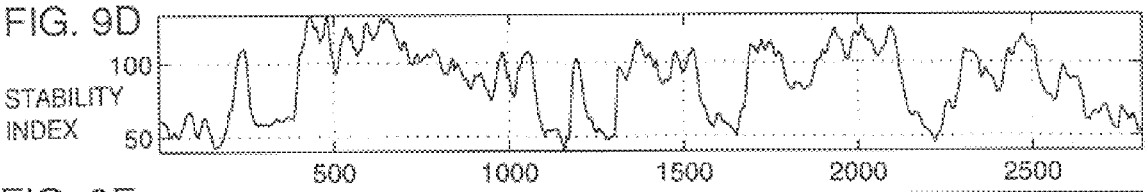
Figure 9E:
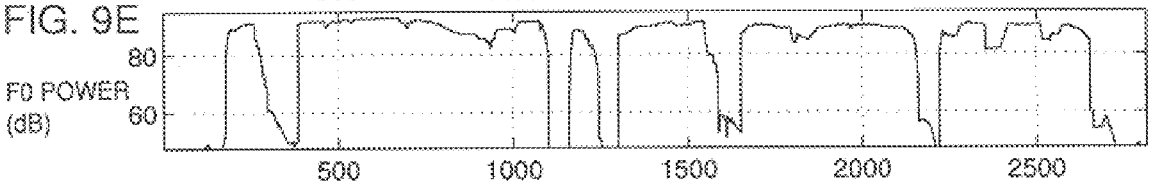
Figure 9F:
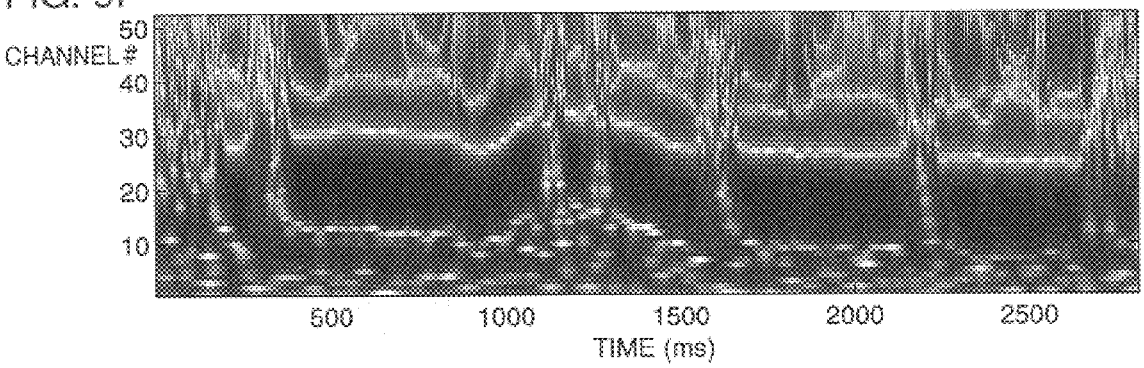

FIGS. 9A–9F show result of analysis of an actual speech waveform, of a sentence "BAKUONGA GINSEKAINO KOUGENNI HIROGARU." This sentence is known as an example difficult for pitch extraction, as it includes plosives and fricatives. FIG. 9A represents speech waveform, FIG. 9B speech power, FIG. 9C fundamental frequency, FIG. 9D stability index, FIG. 9E F0 power, and FIG. 9F gray-scale map of the stability index. In the gray-scale in FIG. 9F, dark tone represents higher stability. In fundamental frequency in FIG. 9C, thin solid lines represent portions which are determined to have been caused by vibration of vocal cord.

Figure 10:
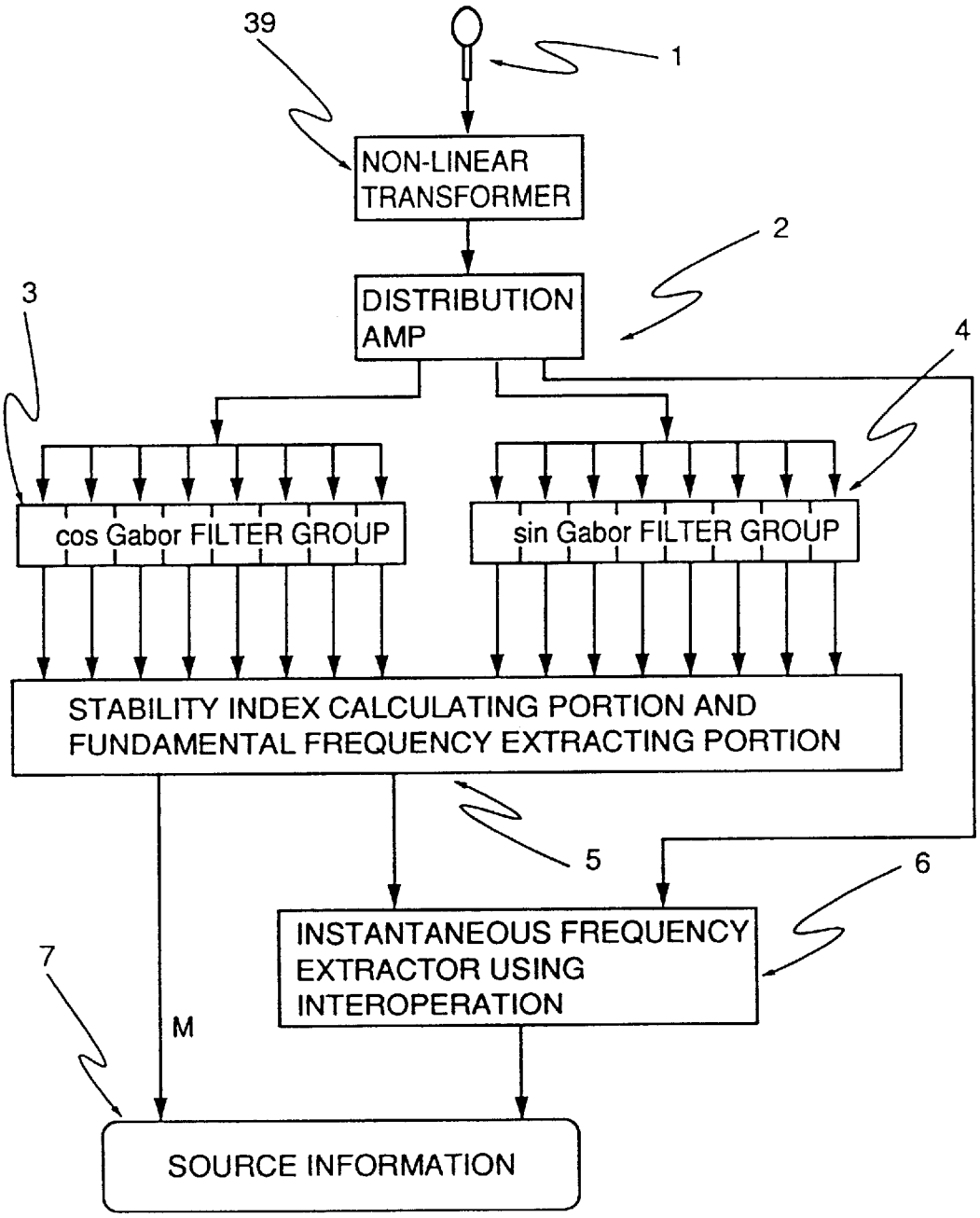
FIG. 10 is a block diagram showing another embodiment of the present invention.

FIG. 10 is a block diagram of one embodiment to be applied to analysis of a signal which does not have fundamental component but has approximately periodical nature in envelope. In the embodiment shown in FIG. 10, the signal is not directly used but is subjected to non-linear transformation by half-wave rectification, for example, and therefore even when the signal does not include fundamental wave component, the signal can be transformed to one having approximately periodical fundamental component if the envelope has approximately periodical characteristic. More specifically, by the provision of non-linear transformer 39 between microphone 1 and distribution amplifier 2, this embodiment is implemented. As for non-linear transform, envelope extracting process using half-wave rectification or Hilbert transform, weighted sum of half-wave rectification band by band using a group of filters, or weighting sum of envelope extracting process band by band using a group of filters may be utilized.

Figure 11:
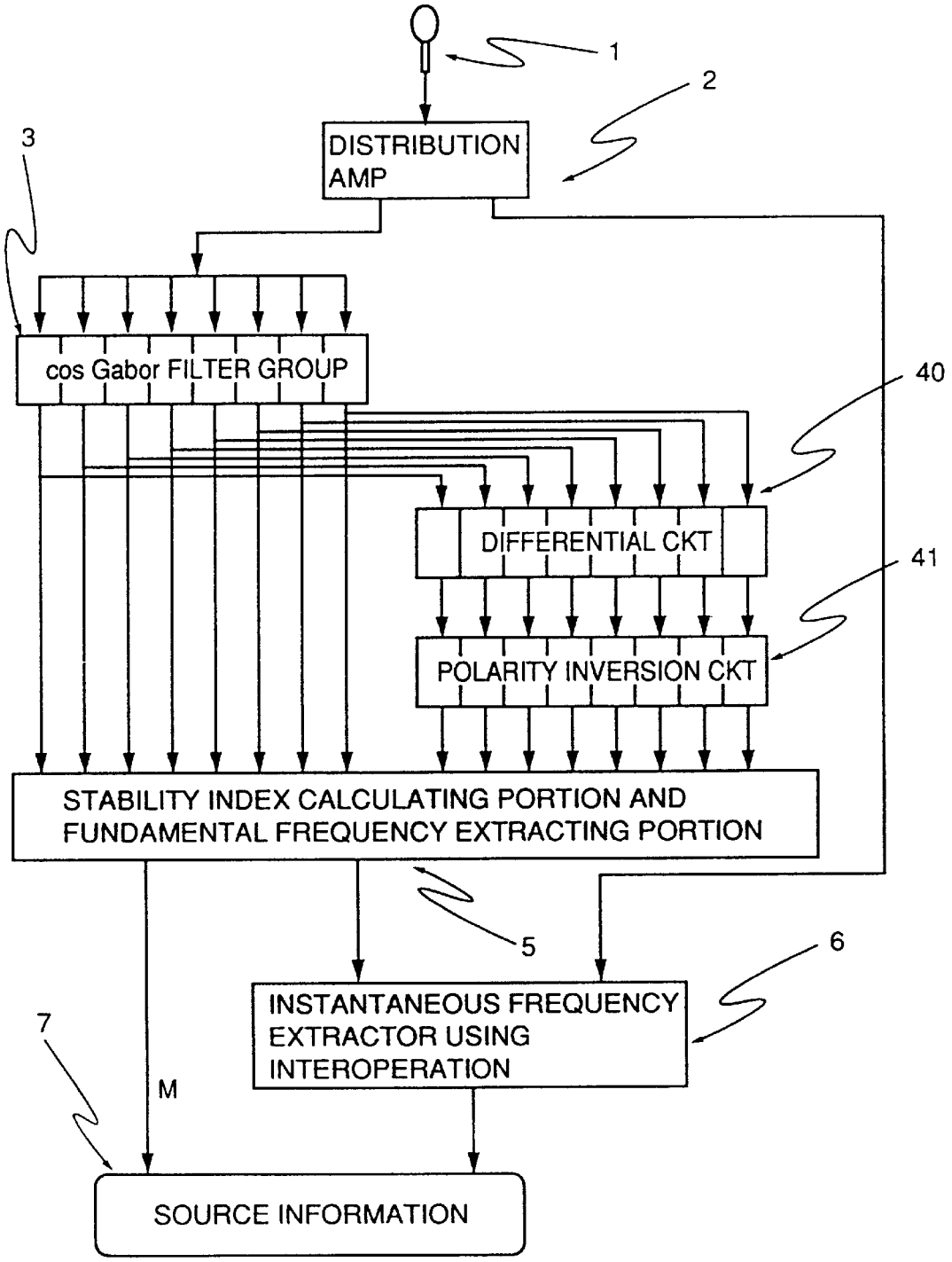
FIG. 11 is a block diagram showing a still further embodiment of the present invention.

FIG. 11 shows a still further embodiment of the present invention. In this embodiment shown in FIG. 11, in place of two sets of filter groups, that is cos Gabor filter group 3 and sin Gabor filter group 4 shown in FIG. 1 above, one set of filter group is used for calculating magnitudes of amplitude modulation and frequency modulation. Utilizing the fact that time differential of a filter output is, if an output signal is sin, a cos, it is possible to adjust gain by time differentiating the signal of real part in place of the signal of imaginary part of FIG. 2 with the polarity inverted. By this method, sin Gabor filter group 4 of FIG. 1 is omitted, differential circuit 40 and polarity inversion circuit 41 are provided, and an input to the real part is passed through differential circuit 40 and polarity inversion circuit 41 to be used as an input to the imaginary part.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An apparatus for signal analysis for extracting fundamental frequency of an input signal, comprising:

distributing means for distributing said input signal;

a plurality of filter groups having mutually different central frequencies at cut-off characteristic moderate on low frequency side and steep on high frequency side, to each of which one signal distributed by said distributing means is input;

calculating means for calculating stability index which is a mathematical index representing fundamentalness of said input signal, by finding magnitude of amplitude modulation and magnitude of frequency modulation of output signals from said filter group; and fundamental frequency extracting means for calculating the fundamental frequency as an instantaneous frequency based on an output of a filter indicating maximum stability based on the result of calculation by said calculating means.

2. The apparatus for signal analysis according to claim 1, wherein said plurality of filter groups include a cos Gabor filter group outputting a signal corresponding to a real part of a Gabor function, and a sin Gabor filter group outputting a signal corresponding to an imaginary part of said Gabor function; and said calculating means calculates said stability index from a signal of said real part and a signal of said imaginary part.

3. The apparatus for signal analysis according to claim 1, wherein said filter group includes a cos Gabor filter group outputting a signal corresponding to a real part of a Gabor function;

said apparatus further comprising differential means for differentiating an output from said cos Gabor filter; and polarity inversion means for inverting an output from said differential means for outputting an imaginary part of said Gabor function; wherein said calculating means calculates said stability index from the signal of said real part and the signal of said imaginary part.

4. The apparatus for signal analysis according to claim 1, further comprising means for performing non-linear transform of said input signal to obtain a signal not including a fundamental component and for applying the signal to said distributing means.

5. A method of signal analysis for extracting fundamental frequency of an input signal, comprising:

a first step for calculating a stability index which is a mathematical index representing fundamentalness of said input signal, by using a filter having moderate cut-off characteristic on low frequency side and steep cut-off characteristic on high frequency side; and a second step for extracting fundamental frequency using a filter selected based on said calculated stability index and calculating an instantaneous frequency from an output of the filter.

6. The method of signal analysis according to claim 1, wherein said first step includes the step of calculating said stability index by finding magnitude of amplitude modulation and magnitude of frequency modulation of a filter output signal using the output from said filter.

7. The method of signal analysis according to claim 1, wherein said second step includes the step of calculating an approximate value of fundamental frequency as instantaneous frequency from the output of a filter indicating maximum stability based on the calculation of said stability index.

8. The method of signal analysis according to claim 7, wherein said second step includes the step of extracting precise instantaneous frequency by interpolating a value of instantaneous frequency from an adjacent frequency channels based on said approximate value of fundamental frequency.

* * * * *